US011124923B2

(12) United States Patent
Ganz

(10) Patent No.: US 11,124,923 B2
(45) Date of Patent: Sep. 21, 2021

(54) METHOD AND TRACK-BUILDING MACHINE FOR RENEWING SLEEPERS OF A TRACK FORMED FROM RAILS AND THE SLEEPERS

(71) Applicant: MATISA MATERIEL INDUSTRIEL S.A., Crissier (CH)

(72) Inventor: Joerg Ganz, Etoy (CH)

(73) Assignee: MATISA Materiel Industriel S.A., Crissier (CH)

( * ) Notice: Subject to any disclaimer, the term of this patent is extended or adjusted under 35 U.S.C. 154(b) by 532 days.

(21) Appl. No.: 15/773,379

(22) PCT Filed: Nov. 3, 2016

(86) PCT No.: PCT/EP2016/076598

§ 371 (c)(1),
(2) Date: May 3, 2018

(87) PCT Pub. No.: WO2017/076994

PCT Pub. Date: May 11, 2017

(65) Prior Publication Data

US 2018/0320324 A1 Nov. 8, 2018

(30) Foreign Application Priority Data

Nov. 3, 2015 (CH) ..... CH01595/15

(51) Int. Cl.
*E01B 29/10* (2006.01)
*E01B 29/06* (2006.01)
*E01B 33/02* (2006.01)

(52) U.S. Cl.
CPC ..... *E01B 29/10* (2013.01); *E01B 29/06* (2013.01); *E01B 33/02* (2013.01)

(58) Field of Classification Search
CPC ..... E01B 29/10; E01B 29/06; E01B 29/05; E01B 33/02
See application file for complete search history.

(56) References Cited

U.S. PATENT DOCUMENTS 4,542,697 A 9/1985 Cicin-Sain
4,784,063 A * 11/1988 Theurer ..... E01B 29/02 104/3
4,867,068 A * 9/1989 Valditerra ..... E01B 35/06 104/2

(Continued)

FOREIGN PATENT DOCUMENTS

CH 683011 A5 12/1993
EP 0089076 B1 7/1987

(Continued)

*Primary Examiner* — Scott A Browne
(74) *Attorney, Agent, or Firm* — Laurence A. Greenberg; Werner H. Stemer; Ralph E. Locher

(57) ABSTRACT

In a method for renewing sleepers of a track formed of rails and the sleepers, the placement of skids, which support a machine frame of a track-building machine on the sleepers, is preceded by the machine frame being intermediately supported on the sleepers. The two rails are then distanced from one another, while avoiding a breakage separation, in a track section that includes both the region of the skids and the intermediate support. After supporting the machine frame on the skids, the intermediate support is lifted off the sleepers and work is begun.

2 Claims, 2 Drawing Sheets

(56) References Cited

U.S. PATENT DOCUMENTS

| | | | | | |
|---|---|---|---|---|---|
| 5,337,675 | A * | 8/1994 | Aubermann | ..... | B61D 15/00 104/2 |
| 5,361,704 | A | 11/1994 | Bounds | | |
| 5,609,106 | A * | 3/1997 | Aubermann | ..... | E01B 29/05 104/5 |
| 2010/0132582 | A1 * | 6/2010 | Theurer | ..... | E01B 29/24 104/2 |

FOREIGN PATENT DOCUMENTS

| | | | | | |
|---|---|---|---|---|---|
| EP | 0670932 | B1 | 8/1997 | | |
| FR | 1027113 | A | 5/1953 | | |
| FR | 2546925 | A1 * | 12/1984 | ..... | E01B 29/02 |

* cited by examiner

METHOD AND TRACK-BUILDING MACHINE FOR RENEWING SLEEPERS OF A TRACK FORMED FROM RAILS AND THE SLEEPERS

BACKGROUND OF THE INVENTION

Field of the Invention:

The invention relates to a method for renewing sleepers of a track formed from rails and the sleepers, wherein, in the region of skids which support a machine frame of a track construction machine on the sleepers, the rails are spaced apart from one another with respect to a track transverse direction extending normally to a track longitudinal direction. The invention also relates to a track construction machine for carrying out the method.

According to EP 0 670 932 B1, a track construction machine for renewing railroad tracks is known, which has a machine frame supported on rail bogies. At one end thereof, devices for picking up old sleepers and laying new sleepers and for preparing the ballast bed are arranged on a boom that projects in the machine longitudinal direction. The rail bogie located in this region is supported on skids during the working phase, said skids being movable on the old sleepers of the track after the sleepers have been freed from the old rails by spreading apart the latter.

EP 0 089 076 B1 and CH 683 011 A5 also describe such supporting of a bogie of a machine frame on exposed sleepers of a track via skids.

SUMMARY OF THE INVENTION

The object of the present invention is now to create a method and a track construction machine of the type mentioned at the beginning, with which a sleeper changing operation is able to be optimized.

This object is achieved according to the invention with a method and a track construction machine of the generic type by the features as claimed.

The possibility, created hereby, of a sleeper change without the conventional severing, normal for this purpose, of the old rails is of great advantage in particular at those sites at which only the sleepers need to be renewed, but not the rails. In these cases, which arise relatively frequently in practice, it has hitherto been necessary to reconnect the rails at the end of the site and then to neutralize the track in order to reestablish the prescribed rail tension. This complicated working step, which causes additional, extended track blocking times and higher costs, can now be favorably dispensed with, since the tension of the track can be maintained during the sleeper renewal.

Further advantages of the invention are additionally apparent from the description of the drawing.

BRIEF DESCRIPTION OF THE SEVERAL VIEWS OF THE DRAWING

The invention is described in more detail in the following text on the basis of an exemplary embodiment illustrated in the drawing, in which.

DESCRIPTION OF THE INVENTION

Figure 1:
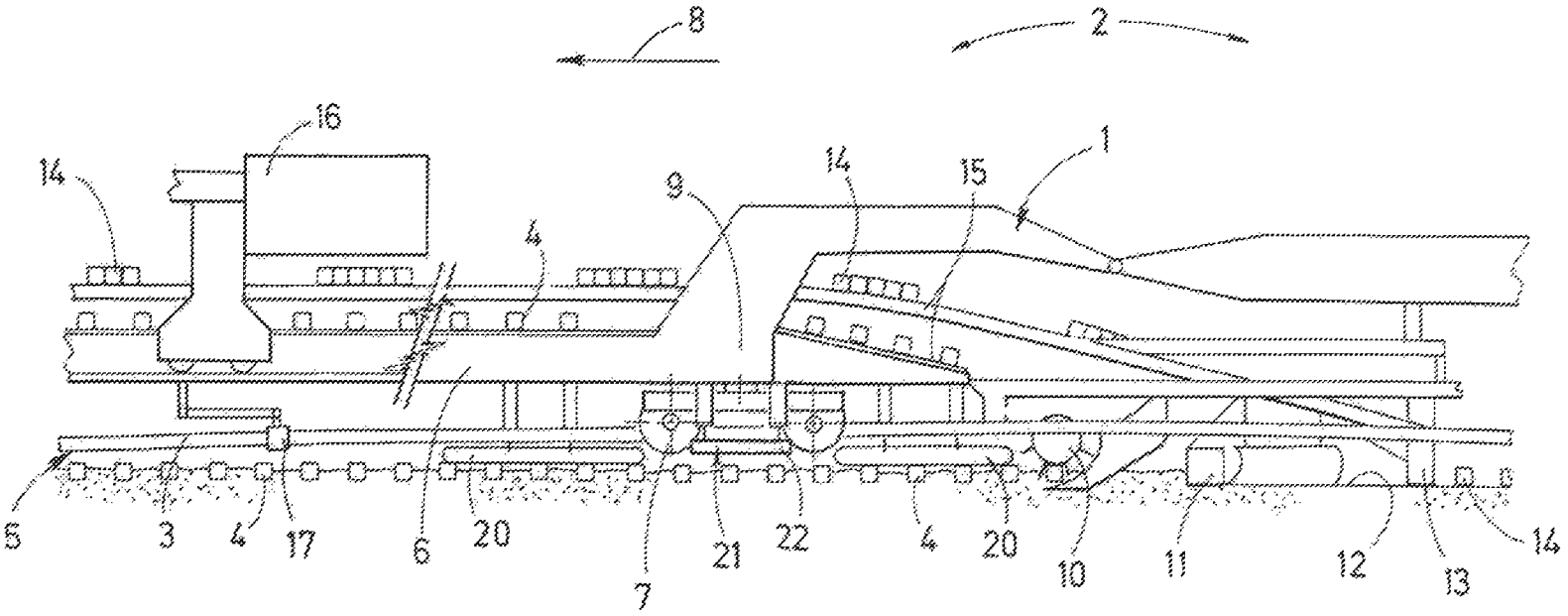
FIG. 1 shows a side view of a section of a track construction machine configured according to the invention, and FIGS. 2*a* to 2*d* each show a schematic plan view of different phases of the work of the machine.

A track construction machine 1 illustrated in FIG. 1 is part of a track renewal train 2 (known per se) which is composed of a plurality of vehicles coupled together and is configured to renew a track 5 formed from rails 3 and sleepers 4. The machine 1 has a machine frame 6 which is able to travel on the track 5 in a working direction 8 via rail bogies 7 and is connected at its ends to further vehicles (not shown) of the renewal train 2.

Located at the rear end 9, with regard to the working direction 8, of the machine frame 6 are various working units in the form of a device 10 for picking up old sleepers 4, a ballast plow 11 for processing an exposed track bed 12, and a device 13 for laying new sleepers 14. Conveyor belts 15 are provided for sleeper transport from and to sleeper wagons (not illustrated) by means of a gantry crane 16. Rail guiding clamps 17 serve to lift the rails 3 from the old sleepers 4 and spread them or space them apart from one another in a track transverse direction 19 extending normally to a track longitudinal direction 18 (see FIG. 2).

Provided in each of the regions—with regard to the working direction 8—immediately in front of and behind the rail bogie 7 arranged at the rear end 9 of the machine frame 6 is a pair of skids 20 which—as can be seen in FIG. 2—are each spaced apart from one another in the track transverse direction 19 at a spacing corresponding approximately to the spacing of the rails 3 and are configured in a vertically adjustable manner. Furthermore, located between the two pairs of skids 20 is a likewise vertically adjustable intermediate support 21 which is connected to the machine frame 6 and consists, in the example illustrated here, of a total of four supporting devices 22. These are arranged alongside one another, in the track transverse direction 19, in the region of the rail bogie 7 and distributed approximately uniformly along the length of a sleeper 4. (Embodiments with only one or a plurality of supporting devices are equally possible in the scope of the invention).

Figure 2D:
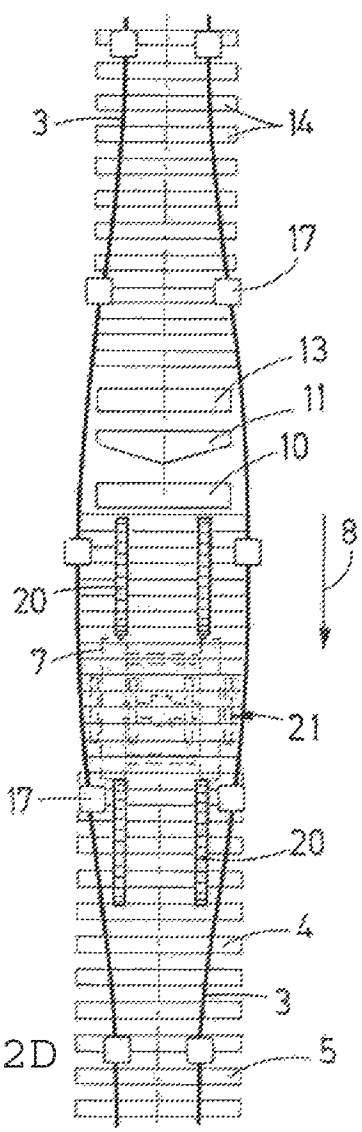
Figure 2C:
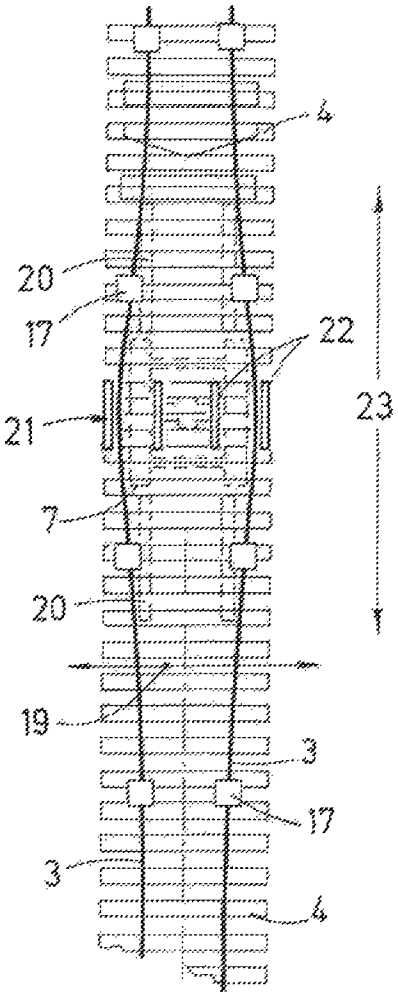
Figure 2B:
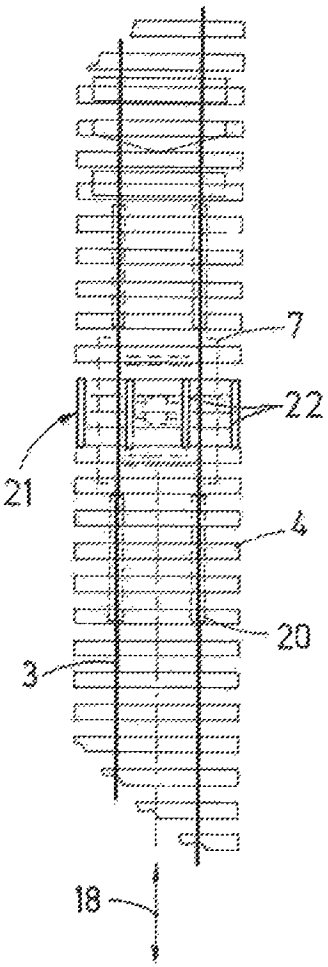
Figure 2A:
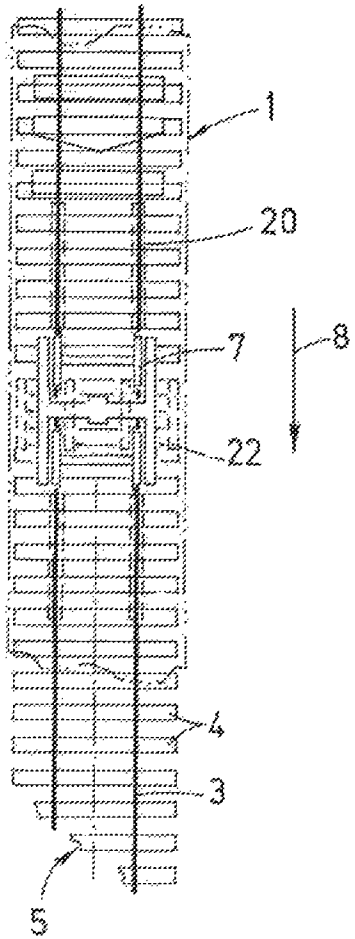

FIGS. 2*a* to 2*d* now show the method sequence according to the invention during sleeper renewal without a rail change. The track renewal train 2 is driven into the site until the rail bogie 7 is located at the point where the sleeper change is intended to start (FIG. 2*a*). Then, the supporting devices 22 of the intermediate support 21 are lowered onto the old sleepers 4 or supported thereon and as a result the rail bogie 7 is lifted automatically off the rails 3 (FIG. 2*b*). Alternatively, the supporting devices 22 can also be supported on the track bed 12.

Following removal of the rail fasteners, the two rails 2 are now spread apart in the track transverse direction 19 by means of the track guiding clamps 17, without being severed and thus with the rail tension being maintained. This takes place in a track section 23 which comprises both the region of the skids 20 in front of and behind the rail bogie 7 and the intermediate support 21, such that both pairs of skids 20 can be laid at the same time on the sleepers 4 freed of the rails 3 (FIG. 2*c*).

Subsequently, the intermediate support 21 is taken out of operation again by vertical adjustment, such that the machine frame 6 of the track construction machine 1 now rests on the old sleepers 4 via the skids 20 and can be slid forward along said sleepers 4 in the working direction 8 in the context of working forward travel, while the removal of the old sleepers 4 and the installation of new sleepers 14 is carried out by way of the devices 10 and 13 as far as the end of the site. The disengagement operation of the track renewal train 2 at this point finally takes place in an analogously opposite manner to the engagement operation.

The invention claimed is:

1. A method for renewing sleepers of a track that is formed of rails and the sleepers, the method comprising:

providing a track construction machine with a machine frame and a front pair of skids and a rear pair of skids configured to support the machine on the sleepers;

prior to placing the front pair of skids and rear pair of skids on the sleepers, supporting the machine frame on the sleepers or on a track bed with a vertically adjustable intermediate support disposed between the rails with respect to a track transverse direction and extending between the front pair of skids and the rear pair of skids with respect to a track longitudinal direction;

subsequently spacing the rails apart from one another in a track transverse direction extending perpendicular to a track longitudinal direction, while avoiding a separation of the rails, within a section of the track that includes both a region of the front pair of skids and rear pair of skids and of the intermediate support; and supporting the machine frame on the front pair of skids and rear pair of skids, subsequently removing the intermediate support from the sleepers or the track bed and starting a forward travel while renewing the sleepers of the track.

2. A track construction machine for renewing sleepers of a track having rails and sleepers, the machine comprising:

a machine frame;

a front pair of skids and a rear pair of skids configured to support said machine frame on the sleepers; and a vertically adjustable intermediate support connected to said machine frame between said front pair and said rear pair of skids with regard to a track longitudinal direction, said intermediate support being configured to support said machine frame directly on the sleepers or on a track bed independently of said front pair of skids and rear pair of skids said intermediate support having a supporting device for being lowered directly onto the sleepers or the track bed between the rails with respect to a track transverse direction.

* * * * *